US005732625A

United States Patent [19]

Klingler et al.

[11] Patent Number: 5,732,625

[45] Date of Patent: Mar. 31, 1998

[54] METHOD AND SYSTEM FOR TRANSMITTING SIGNALS IN A PRINTING MACHINE

[75] Inventors: Horst Klingler, Muhlheim/Main; Gerold Wende, Frankfurt am Main; Frank Schonfeld, Mulheim/Main, all of Germany

[73] Assignee: MAN Roland Druckmaschinen AG, Germany

[21] Appl. No.: 638,541

[22] Filed: Apr. 26, 1996

[30] Foreign Application Priority Data

Apr. 27, 1995 [DE] Germany ..... 195 15 557.7

[51] Int. Cl.[6] ..... B41F 13/12

[52] U.S. Cl. ..... 101/248; 101/181

[58] Field of Search ..... 101/181, 248

[56] References Cited

U.S. PATENT DOCUMENTS 5,309,834 5/1994 Koch ..... 101/248

FOREIGN PATENT DOCUMENTS 41 29 373 A1 3/1993 Germany ..... 101/181

OTHER PUBLICATIONS

Couch II, Leon W. : "*Digital And Analog Communication Systems*;" 4th edition, New York, MacMillan Publishing Company, 1993, p. 782, ISBN 0–02–325281–2.

Haykin, Simon: "*Digital Communications*;," New York, John Wiley & Sons, 1988, pp. 431–433, ISBN 0–471–63775–0.

Local Networks, Second Edition, William Stallings, Ph.D., Copyright ©1987, Chapter 5.

Handbook of Computer–Communications Standards, vol. 2, Local Network Standards, William Stallings, Ph.D., Copyright ©1987, Chapter 4.

*Primary Examiner*—John S. Hilten
*Assistant Examiner*—Steven S. Kelley
*Attorney, Agent, or Firm*—Leydig, Voit & Mayer, Ltd.

[57] ABSTRACT

A method and a system for signal transmission between two computers is described, wherein one of the computers is fixedly mounted and the other computer is mounted in a rotational element, such as a plate cylinder of a printing machine. The transmission channel includes a rotational transformer. The rotational transformer utilized to transmit the signals is of single channel design. Data collisions resulting from the simultaneous transmission of messages are avoided through detection by the computers. Accordingly, both computers simultaneously transmit the signals present on the transmission channel during the transmission of a message and compare them with the transmitted signals. If an inequality is determined, the transmission procedure is aborted and restarted after a predetermined period of time.

7 Claims, 2 Drawing Sheets

METHOD AND SYSTEM FOR TRANSMITTING SIGNALS IN A PRINTING MACHINE

BACKGROUND OF THE INVENTION

1. Field of the Invention

The present invention relates to a method and a system for transmitting signals between two stations within a printing machine, and more particularly, to a method and system for serial, bidirectional signal transmission between two stations in a printing machine over a single transmission channel.

2. Discussion of the Related Art

DE 4 129 373 A1 discloses a device for transmitting electrical energy and data from a fixed machine component in a printing machine to a rotating machine component in the same printing machine. The device comprises an electric rotational transformer for supplying power, i.e., current, from an external source to remote-adjustable drives which are mounted in a plate cylinder of the printing machine. In addition, position instructions can be fed from a controller located outside the plate cylinder through the rotational transformer. The measured values of position sensors assigned to the remote-adjustable drives can likewise be transmitted to the outside controller via the rotational transformer. The drives arranged in the plate cylinder serve in particular for the remote adjustment of a printing plate which if fitted onto the cylinder so that the register can be corrected in the lateral, circumferential and oblique register direction when the printing machine is running.

If the rotational transformer described in the above mentioned reference is realized with one pair of windings for supplying signals and one pair of windings for supplying current, the data can be transmitted in a bidirectional fashion. Therefore, on the transmission channel, signals are transmitted from the controller which may be fixed to the machine into the rotating plate cylinder, and also vice versa from the position sensors of the plate cylinder to the controller. However, complex control functions give rise to a high data rate in both directions so that data collisions, i.e., both ends are attempting to transmit data simultaneously on the transmission channel, cannot be ruled out. This problem can be avoided by providing more than one transmission channel, that is to say in each case one transmission and one reception channel (full duplex). However, in the case of a rotational transformer designed according to the transformer principle, this means that a further pair of windings has to be arranged, which, because of the strict precision requirements in particular with respect to the air gap tolerance etc., considerably complicates the design of such a transformer. In order to avoid data collisions in single-channel, bidirectional transmission systems, it is also known to construct one station as a master and the second station as a slave and to provide a so-called polling mode. However, a disadvantage with this is that the slave station cannot transmit spontaneously.

SUMMARY OF THE INVENTION

In accordance with one aspect, the present invention is directed to a process for signal transmission between a fixed station and a station in a rotating component within a printing machine in which data is exchanged serially and bidirectionally over a single channel transmission system. During the transmission of a message the signals on the single channel transmission system are detected by the sending station in each case and compared with the signals being transmitted to verify proper transmission, the received signals are received by the receiving station in each case within a first predetermined time interval, that in the event of a difference between the transmitted and the received signals, the transmission process is repeated by the sending station within the first predetermined time interval, in which case on absence of the receipt signal by the receiving station there occurs a repetition of the sending of the message in correspondence to a predetermined number in each case separated from one another by the first predetermined time interval, and that between the sending of two different messages from one of the stations a second predetermined time interval is provided, the second predetermined time interval being equal to or greater than twice the first predetermined time interval.

In accordance with another aspect, the present invention is directed to a system for signal transmission between a fixed station and a station in a rotating component within a printing machine in which data is exchanged serially and bidirectionally over a single channel. The system comprises a rotational transformer including a rotating portion having a rotary winding and mounted to the rotating component and a fixed portion having a fixed winding and mounted to a frame of the printing machine. The rotating winding is inductively coupled to the fixed winding. The system also comprises a first universal asynchronous receiver/transmitter coupled to the station in the rotating component, first transmit and receive drivers connected between the first universal asynchronous receiver/transmitter and the rotating portion of the rotational transformer, the output of the first transmit driver is connected to the input of the first receive driver, a second universal asynchronous receiver/transmitter coupled to the fixed station, and second transmit and receive drivers connected between the second universal asynchronous receiver/transmitter and the fixed portion of the rotational transformer, the output of the second transmit driver is connected to the input of the second receive driver.

The present invention is directed to a method and system for the serial, bidirectional transmission of information between stations in a printing machine with the greatest possible degree of protection against interference over a single transmission channel.

According to the present invention there is provision that the signals present on the transmission system are detected at the same time as the transmission of a message from the transmitting station and are compared with the transmitted signals, and that, given the presence of a difference between the transmitted and the received signals, the transmission procedure is repeated.

Preferably, there may be provision for the comparison of the transmitted and received signals to take place simultaneously in at least one of the stations and for the transmission process to be aborted immediately if a difference is determined.

There may also be provision for at least one of the stations to carry out the comparison between the transmitted and the received signals after the complete transmission of a message.

BRIEF DESCRIPTION OF THE DRAWINGS

Exemplary embodiments of a system and method for transmitting signals in a printing machine in accordance with the present invention is described below with reference to the accompanying drawings in which.

DETAILED DESCRIPTION OF THE PREFERRED EMBODIMENTS

Figure 1:
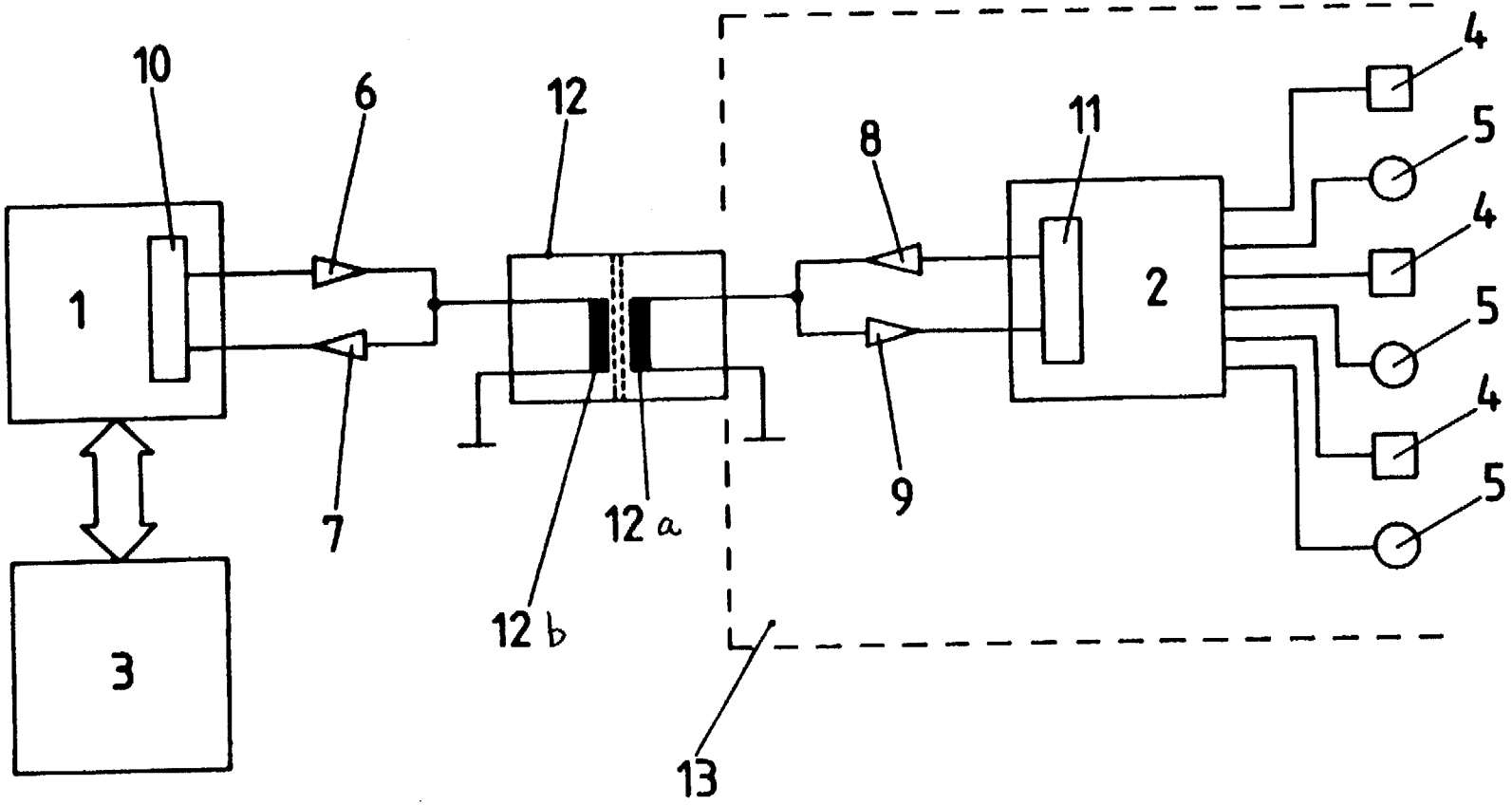
FIG. 1 illustrates the components of the transmission system according to the present invention.

FIG. 1 is a block diagram of an exemplary system for transmitting signals between two stations in a printing machine. As illustrated in FIG. 1, a first computer 2, which is configured as a controller, is arranged in a plate cylinder 13, which is indicated by broken lines, of a printing machine. The first computer 2 is connected to positioning drives 4. The first computer 2 is also connected to sensors, i.e., signal transmitters 5 via interface circuits (not illustrated). A transmit driver 8 and a receive driver 9 are connected to a first universal asynchronous receiver/transmitter (UART) 11 of the first computer 2 for the transmission and reception of data. Since the transmit and receive drivers 8,9 are connected to the same line of the transmission channel, which is described in detail below, the output of the transmit driver 8 is simultaneously connected to the input of the receive driver 9. The first UART 11, which enables bidirectional serial data exchange over one channel, allows for the connection of the output of the transmit driver 8 to the input of the receive driver 9. The first UART 11 is a commonly utilized device functioning as a full-duplex or half-duplex, serial communication line controller and data interface.

A rotating portion of a rotational transformer 12 is mounted on a pin (not illustrated) of the plate cylinder 13. The rotating portion of the rotational transformer 12 includes a rotating winding 12*a*, which rotates with the plate cylinder 13. A fixed winding 12*b* is arranged in a fixed portion of the rotational transformer 12 and is in inductive contact with the rotating winding 12*a*. The fixed portion of the rotational transformer 12 is mounted to the frame of the printing unit. A second computer 1, which is fixedly mounted to the frame in the printing unit is also connected to a transmit driver 6 and a receive driver 7 via a second UART 10. Similarly to the connections of the transmit and receive drivers 8,9 described above, the output of the transmit driver 6 is connected to the input of the receive driver 7 since both drivers are connected to the same line of the transmission channel. Both transmit drivers 6,8, and both receive drivers 7,9 may comprise any suitable device for facilitating signal transmission. In the exemplary embodiment, the transmit and receive drivers comprise amplifiers.

The second computer 1, which as stated above is arranged in the printing unit, is coupled to a controller 3 of the printing machine so that actuation instructions can be transmitted from the controller 3 to the second computer 1 via an input device (not illustrated). The second computer 1 then transmits signals, corresponding to the actuation instructions, to the first computer 2 mounted in the plate cylinder 13 via the second UART 10 and the transmit driver 6. During this process, the first computer 2 receives the signals corresponding to the actuation information via the receive driver 9 and the first UART 11. These signals are then converted by the first computer 2 into corresponding actuation instructions for implementation by the associated positioning drives 4. The power supply component of the rotational transformer 12 is not illustrated in FIG. 1.

The sensors 5, which are also coupled to the positioning drives 4 as well as the first computer 2 comprise position sensors. The position sensors 5 may comprise any suitable device for determining position, such as optical sensors. The position sensors 5 transmit signals corresponding to the positions of the positioning drives 4 to the second computer 1 over the transmission channel via the first computer 2, the first UART 11, the transmit driver 8 of the first computer 2, the rotational transformer 12, the receive driver 7 of the second computer 1 and the second UART 10.

Figure 2:
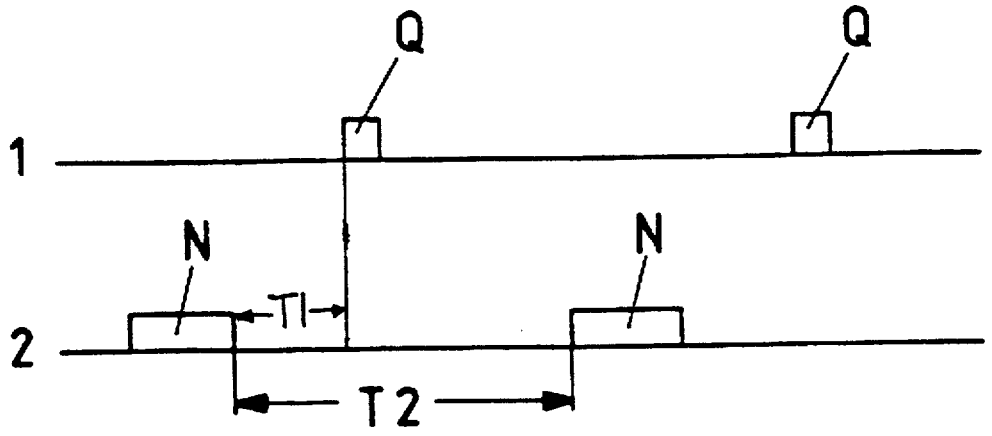
FIGS. 2 to 4 are timing diagrams illustrating the principle of signal transmission in accordance with the present invention.

FIG. 2 is a timing diagram illustrating the basic timing sequence of the signal transmission method provided according to the present invention. After the first computer 2 has output a message N and after the second computer 1 has received this signal via the transmission channel comprising the rotational transformer 12, the transmission of an acknowledgement signal Q takes place within a time period T1 of, for example, 200 ms over the same transmission channel. In addition, there is provision that, after a time period T2 which is equal to or greater than twice T1, the first computer 2 is able to transmit a message N again, wherein the message N is then in turn correctly confirmed by the second computer 1 with the acknowledgement signal Q. Essentially, since both computers 2,1 have to acknowledge a received message within the time period T1 and provision is made for a message to be repeated at the earliest possible time after T1, then T2 preferably is equal to or greater than twice T1. FIG. 2 thus illustrates collision-free data traffic between the first and second computers 2,1 via the transmission channel.

Before one of the second and first computers 1,2 transmits signals via the transmit drivers 6,8, a test is performed via the receive drivers 7,9 and the corresponding second and first UARTs 10,11 to determine whether the transmission channel is free. During this test process a determination is made as to whether a signal is present on the transmission channel for a predetermined time interval. Since, however, it cannot be ruled out that both the second and first computers 1,2 simultaneously output a message N onto the transmission channel, there is provision for each of the second and first computers 1,2 which transmits via the transmit drivers 6,8 to read in the signals of the receive drivers 7,9 via their respective UARTs 10,11.

During the interference-free or collision-free transmission of a message N from the first computer 2 to the second computer 1 (described above with reference to FIG. 2), the signal transmitted by the first computer 2 is the same in terms of content as the signal received by the receive driver 9 associated with the first computer 2 since the output of the transmit driver 8 is connected to the input of the receive driver 9. The signals fed to the UARTs 10,11 of the respective computers 1,2 via the receive drivers 7,9 are stored during the transmission procedure in memory areas provided for this purpose and are compared with the correspondingly transmitted signals to verify the integrity thereof. Essentially, this is a wrap-around procedure.

Figure 3:
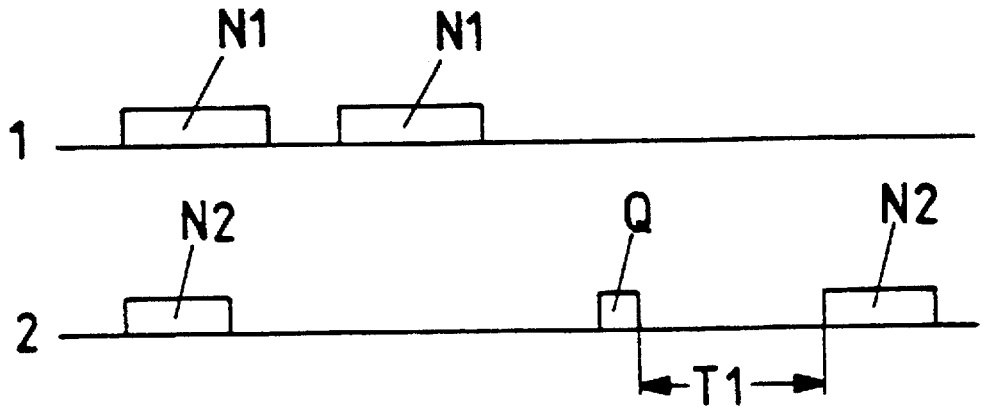

FIG. 3 is a timing diagram illustrating a situation in which the second computer 1 and the first computer 2 attempt to transmit a message N1 and N2 simultaneously. Since both computers 1,2 transmit and receive simultaneously, as provided for according to the present invention, it is determined that both the second computer 1 and the first computer 2 in each case receive different signals from those which they have transmitted. Subsequently, the transmission procedure is aborted by both computers 1,2 and the second computer 1, which has a transmission priority over the first computer 2, transmits the message N1 again after the failed transmission attempt has been aborted. After the first computer 2 has the received the message N1, an acknowledgement signal Q is transmitted, after which the message N2 is transmitted after an off time T1 of, for example, 200 ms. The message N2 is then confirmed by the second computer 1, likewise with the acknowledgement signal Q. In addition, there is provision for the second computer 1 which is connected to the controller 3 to have a transmission priority so that the repeated transmission of the message N1 takes place immediately after the failed transmission attempt, whereas the first computer 2 remains disabled from transmitting for a prescribed time period. This avoids a repeated data collision.

Figure 4:
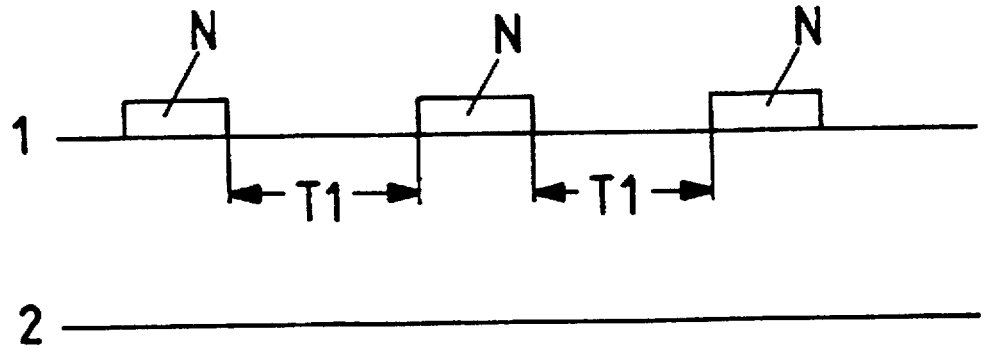

FIG. 4 is a timing diagram illustrating a situation in which, in the second computer 1, a message N has been transmitted but has not been acknowledged by the first computer 2. Accordingly, there is a provision for the second computer 1 to repeat the message N a specific number of times and to transmit a fault message to the controller 3 if the acknowledgement still fails to occur. Here, there is also provision for a message N to be repeated at the earliest time possible after a time period T1. As already mentioned, there is provision for both computers 1,2 to have to acknowledge a received message within a time period T1. In addition, there is provision for a time period $T2 \geqq 2 \times T1$ to have to elapse between the transmission of two messages N.

Although shown and described are what is believed to be the most practical and preferred embodiments, it is apparent that departures from specific methods and designs described and shown will suggest themselves to those skilled in the art and may be used without departing from the spirit and scope of the invention. The present invention is not restricted to the particular constructions described and illustrated, but should be construed to cohere with all modifications that may fall within the scope of the appended claims.

What is claimed is:

1. A process for signal transmission between a fixed station and a station in a rotating component within a printing machine in which data is exchanged serially and bidirectionally over a single channel transmission system, wherein during the transmission of a message the signals on the single channel transmission system are detected by the sending station as the signals are being transmitted to the receiving station in each case and compared with the signals being transmitted to verify proper transmission, the received signals are received by the receiving station within a first predetermined time interval, and in the event of a difference between the transmitted and the received signals, the transmission process is repeated by the sending station within the first predetermined time interval, whereupon in the absence of receipt of the signal by the receiving station the sending of the message is repeated in correspondence to a predetermined number in each case separated from one another by the first predetermined time interval, and that between the sending of two different messages from one of the stations a second predetermined time interval is provided, the second predetermined time interval being equal to or greater than twice the first predetermined time interval.

2. The process according to claim 1, wherein the comparing of the transmitted and the received signals occurs simultaneously in at least one of the stations, and upon establishment of a difference between the signals, the transmission process is immediately terminated.

3. The process according to claim 1, wherein at least one of the stations carries out the comparison between the transmitted and received signals after the completion of transmission of a message.

4. The process according to claim 1, wherein after establishing a data collision has occurred on the transmission system, one of the stations immediately repeats the transmission process and the other station is prevented from transmitting a signal for a predetermined time interval.

5. A system for signal transmission between a fixed station and a station in a rotating component within a printing machine in which data is exchanged serially and bidirectionally over a single channel comprising: a rotational transformer including a rotating portion having a rotary winding and mounted to the rotating component and a fixed portion having a fixed winding and mounted to a frame of the printing machine, the rotating winding being inductively coupled to the fixed winding; a first universal asynchronous receiver/transmitter coupled to the station in the rotating component; first transmit and receive drivers connected between the first universal asynchronous receiver/transmitter and the rotating portion of the rotational transformer, the output of the first transmit driver is connected to the input of the first receive driver; a second universal asynchronous receiver/transmitter coupled to the fixed station; and second transmit and receive drivers connected between the second universal asynchronous receiver/transmitter and the fixed portion of the rotational transformer, the output of the second transmit driver is connected to the input of the second receive driver, wherein at least one sending station of the fixed station and the station in the rotating component compares a signal being transmitted from the transmit driver electrically coupled to the at least one sending station with the signal received at the receive driver electrically coupled to the at least one sending station, and upon establishment of a difference between the transmitted and received signals, the at least one sending station terminates transmission of the signal.

6. The system of claim 5, wherein the at least one sending station delays a predetermined time interval before sending a second signal after the establishment of the difference between the transmitted and received signals.

7. The system of claim 6, wherein a first predetermined time interval assigned to one of the fixed station and the station in the rotating component is equal to or greater than twice a second predetermined time interval assigned to the other of the fixed station and station in the rotating component.

* * * * *